US007066619B2

(12) United States Patent
Waters

(10) Patent No.: US 7,066,619 B2
(45) Date of Patent: Jun. 27, 2006

(54) LED PICTURE LIGHT APPARATUS AND METHOD

(76) Inventor: Michael A. Waters, 372 Bateman Cir. North, Barrington Hills, IL (US) 60010

( * ) Notice: Subject to any disclaimer, the term of this patent is extended or adjusted under 35 U.S.C. 154(b) by 207 days.

(21) Appl. No.: 10/652,285

(22) Filed: Aug. 29, 2003

(65) Prior Publication Data

US 2005/0047130 A1 Mar. 3, 2005

(51) Int. Cl.
*F21S 8/00* (2006.01)

(52) U.S. Cl. ..... 362/147; 362/190; 362/204; 40/715

(58) Field of Classification Search ..... 362/184, 362/191, 98, 11, 86, 89, 125, 145, 147, 157, 362/190, 202, 204, 205, 227, 249, 251, 252, 362/362, 368, 370, 800; 33/366.11, 366.24, 33/300, 351, 353, 365; 40/713, 700, 714, 40/715; 248/180.1
See application file for complete search history.

(56) References Cited

U.S. PATENT DOCUMENTS

| | | | | | |
|---|---|---|---|---|---|
| 586,120 | A | * | 7/1897 | Flynn | 40/713 |
| 1,251,349 | A | * | 12/1917 | Day | 33/366.12 |
| 2,233,280 | A | * | 2/1941 | Barnes | 362/319 |
| 2,615,121 | A | | 10/1952 | Cox | |
| 3,475,603 | A | * | 10/1969 | Gheno | 40/715 |
| 3,723,720 | A | * | 3/1973 | Schmidt et al. | 362/183 |
| 3,786,245 | A | * | 1/1974 | Cincotta et al. | 362/183 |
| 4,298,869 | A | | 11/1981 | Okuno | |
| 4,597,554 | A | * | 7/1986 | James | 40/713 |
| 4,656,398 | A | | 4/1987 | Michael et al. | |
| 4,748,545 | A | * | 5/1988 | Schmitt | 362/219 |
| 4,845,481 | A | | 7/1989 | Havel | |
| 4,860,177 | A | * | 8/1989 | Simms | 362/473 |
| 4,963,798 | A | | 10/1990 | McDermott | |
| D312,703 | S | | 12/1990 | Muller et al. | |
| 4,994,944 | A | | 2/1991 | Vernondier | |
| 5,079,679 | A | * | 1/1992 | Chin-Fa | 362/102 |
| 5,134,387 | A | | 7/1992 | Smith et al. | |
| 5,165,783 | A | | 11/1992 | Barron, Sr. | |
| 5,184,114 | A | | 2/1993 | Brown | |
| 5,222,799 | A | | 6/1993 | Sears et al. | |
| 5,285,232 | A | | 2/1994 | Taniguchi et al. | |
| 5,374,876 | A | | 12/1994 | Horibata et al. | |
| 5,544,027 | A | * | 8/1996 | Orsano | 362/105 |
| 5,580,163 | A | | 12/1996 | Johnson, II | |
| 5,595,441 | A | * | 1/1997 | McGee | 362/473 |
| 5,622,423 | A | * | 4/1997 | Lee | 362/186 |

(Continued)

FOREIGN PATENT DOCUMENTS

| | | |
|---|---|---|
| GB | 2 202 098 | 9/1988 |

(Continued)

OTHER PUBLICATIONS

Angelo Brothers Company Accent Lighting Catalog, pp. 170-175 (no date specified).

(Continued)

*Primary Examiner*—Sandra O'Shea
*Assistant Examiner*—Ismael Negron
(74) *Attorney, Agent, or Firm*—Michael Best & Friedrich LLP

(57) ABSTRACT

A LED picture light. The housing is positionable adjacent to a picture in order to illuminate the picture. In some embodiments, the LED's can illuminate the picture without emitting substantial amounts of heat and without emitting substantial amounts of ultraviolet radiation. The picture light can include white and yellow LED's. The picture light can include a level sensor.

8 Claims, 8 Drawing Sheets

U.S. PATENT DOCUMENTS 5,685,637 A 11/1997 Chapman et al.
5,688,042 A * 11/1997 Madadi et al. ..... 362/240
5,697,695 A 12/1997 Lin et al.
5,727,868 A * 3/1998 Sharma ..... 362/147
5,749,646 A 5/1998 Brittell
5,848,489 A * 12/1998 Hartley et al. ..... 40/713
5,924,784 A 7/1999 Chliwnyjet et al.
5,934,787 A * 8/1999 Sharma ..... 362/147
5,955,713 A * 9/1999 Titus et al. ..... 33/366.11
6,016,038 A 1/2000 Mueller et al.
6,019,482 A 2/2000 Everett
6,030,089 A 2/2000 Parker et al.
6,036,334 A * 3/2000 Nakano ..... 362/234
6,150,774 A 11/2000 Mueller et al.
6,166,496 A 12/2000 Lys et al.
6,168,288 B1 * 1/2001 St. Claire ..... 362/184
6,203,170 B1 3/2001 Patrick et al.
6,203,175 B1 * 3/2001 Basacchi ..... 362/287
6,206,541 B1 3/2001 Landamia
6,211,626 B1 4/2001 Lys et al.
6,292,901 B1 9/2001 Lys et al.
6,340,868 B1 1/2002 Lys et al.
6,357,895 B1 3/2002 Kierulf et al.
6,379,022 B1 4/2002 Amerson et al.
6,379,026 B1 4/2002 Petrick
6,390,648 B1 5/2002 Privas et al.
6,400,104 B1 6/2002 Ham
6,402,347 B1 6/2002 Maas et al.
6,431,719 B1 8/2002 Lau et al.
6,433,483 B1 8/2002 Michael et al.
6,459,919 B1 10/2002 Lys et al.
6,485,160 B1 * 11/2002 Sommers et al. ..... 362/184
6,499,859 B1 12/2002 Petzl et al.
6,505,951 B1 1/2003 Lorenzo, Jr. et al.
6,523,972 B1 2/2003 Sharrah et al.
6,528,954 B1 3/2003 Lys et al.
6,583,550 B1 * 6/2003 Iwasa et al. ..... 313/485
2001/0005319 A1 6/2001 Ohishi et al.
2001/0007527 A1 7/2001 Lammers et al.
2001/0009511 A1 7/2001 Griffiths
2001/0012204 A1 8/2001 Sharrah et al.
2001/0028227 A1 10/2001 Lys et al.
2002/0021573 A1 2/2002 Zhang
2002/0048169 A1 4/2002 Dowling et al.
2002/0048177 A1 4/2002 Rahm et al.
2002/0070688 A1 6/2002 Dowling et al.
2002/0071279 A1 6/2002 Katogi et al.
2002/0079834 A1 6/2002 Dai et al.
2002/0109605 A1 8/2002 Liu
2002/0113555 A1 8/2002 Lys et al.
2002/0114155 A1 * 8/2002 Katogi et al. ..... 362/219
2002/0118531 A1 8/2002 Yang
2002/0131275 A1 * 9/2002 Yamamoto et al. ..... 362/555
2002/0145865 A1 10/2002 Gregg
2002/0149933 A1 10/2002 Archer et al.
2002/0159258 A1 10/2002 Beeman
2003/0016532 A1 1/2003 Reed
2003/0026092 A1 2/2003 Reese et al.
2003/0035291 A1 2/2003 Jensen et al.
2004/0012959 A1 * 1/2004 Robertson et al. ..... 362/247

FOREIGN PATENT DOCUMENTS

WO WO01/36864 5/2001

OTHER PUBLICATIONS

DeBruyne Lighting LLC website, light features and specifications, May 5, 2003.
Garbe's website, collector series picture lighting, May 5, 2003.
Lighting Universe website, art & picture lights, May 5, 2003.
Art Experience Inc. website, art lighting, Apr. 30, 2003.
Picture Perfect of Nora Corners website, picture lights, Apr. 30, 2003.
Harrington Lights website, picture lights, Apr. 30, 2003.
Asco website, picture lights, Apr. 30, 2003.
House of Troy website, incandescent picture lights, Apr. 30, 2003.
Hogarth website, picture frame lights, Apr. 30, 2003.
Lamps Plus website, picture lights, Apr. 30, 2003.
FineArtLight LLC website, safe lighting for watercolors and oils, Apr. 30, 2003.

* cited by examiner

LED PICTURE LIGHT APPARATUS AND METHOD

FIELD OF THE INVENTION

The invention relates to a lighting device and method, and more particularly to a picture lighting device and method.

BACKGROUND OF THE INVENTION

Conventional picture lights generally use a fluorescent or incandescent light bulb to illuminate a picture or a piece of artwork. Conventional picture lights are either powered by batteries or by an AC power cord plugged into an outlet. The AC power cord must extend along a wall upon which the picture is mounted from the picture light to the nearest AC outlet. As a result, the AC power cord may interfere with the decorative appearance of the picture or the piece of artwork. If battery power is used, the light bulb generally cannot operate for long periods of time without quickly depleting the batteries or before the light emitted by the light bulb becomes significantly diminished.

SUMMARY OF THE INVENTION

In light of the limitations discussed above, a need exists for a picture light that does not include a power cord and can operate for long periods of time without quickly depleting the batteries and without the light illuminating the picture or the piece of artwork becoming diminished.

One embodiment of the invention provides a picture light including a housing and one or more light-emitting diodes (LED's) coupled to the housing. The housing is positionable adjacent to a picture in order to illuminate the picture. The housing is capable of storing one or more batteries. The picture light can include a bracket coupled to the housing, and the bracket can be attached to a wall adjacent to the picture and/or coupled to a picture frame positioned around the picture.

In one embodiment, the LED's can illuminate the picture for up to approximately 72 hours before the light emitted by the LED's becomes diminished due to the batteries becoming depleted. In some embodiments, the LED's illuminate the picture without emitting substantial amounts of heat and without emitting substantially amounts of ultraviolet radiation.

The housing of the picture light, in some embodiments, is cylindrical in shape and includes an end cap removably positioned on one end of the cylinder. A user can remove the end cap in order to replace the batteries. The housing can also include a tube positioned between the housing and the batteries.

In some embodiments of the invention, the picture light includes white and yellow LED's. The picture light can also include a lens to at least partially cover the white and yellow LED's in order to blend the light emitted by the white and yellow LED's.

In other embodiments, the picture light can include a level sensor coupled to the housing and/or the bracket. The level sensor can generate a signal and/or indicator when the picture is not level. The indicator can be an LED coupled to the housing and/or the bracket. In one embodiment, the level sensor can include a metallic ball contact positioned on an anode rail, a first cathode contact positioned at a first end of the anode rail, and a second cathode contact positioned at a second end of the anode rail. The metallic ball contact can move between a first level position located between the first cathode contact and the second cathode contact and a second non-level position adjacent to one of the first cathode contact and the second cathode contact.

Other features and advantages of the invention will become apparent to those of ordinary skill in the art upon review of the following description, claims and drawings.

DETAILED DESCRIPTION

Figure 1:
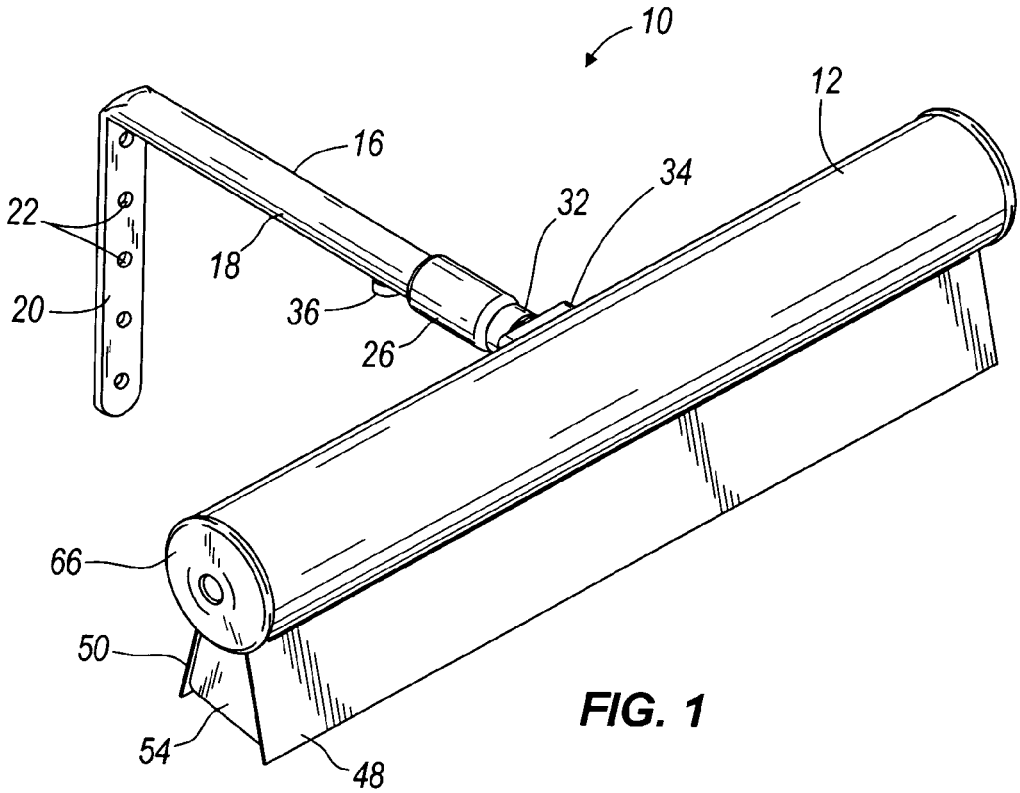
FIG. 1 is a top perspective view of a picture light according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, but rather can also include electrical connections or couplings.

In addition, it should be understood that embodiments of the invention can include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software or programmable controllers. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

Figure 2:
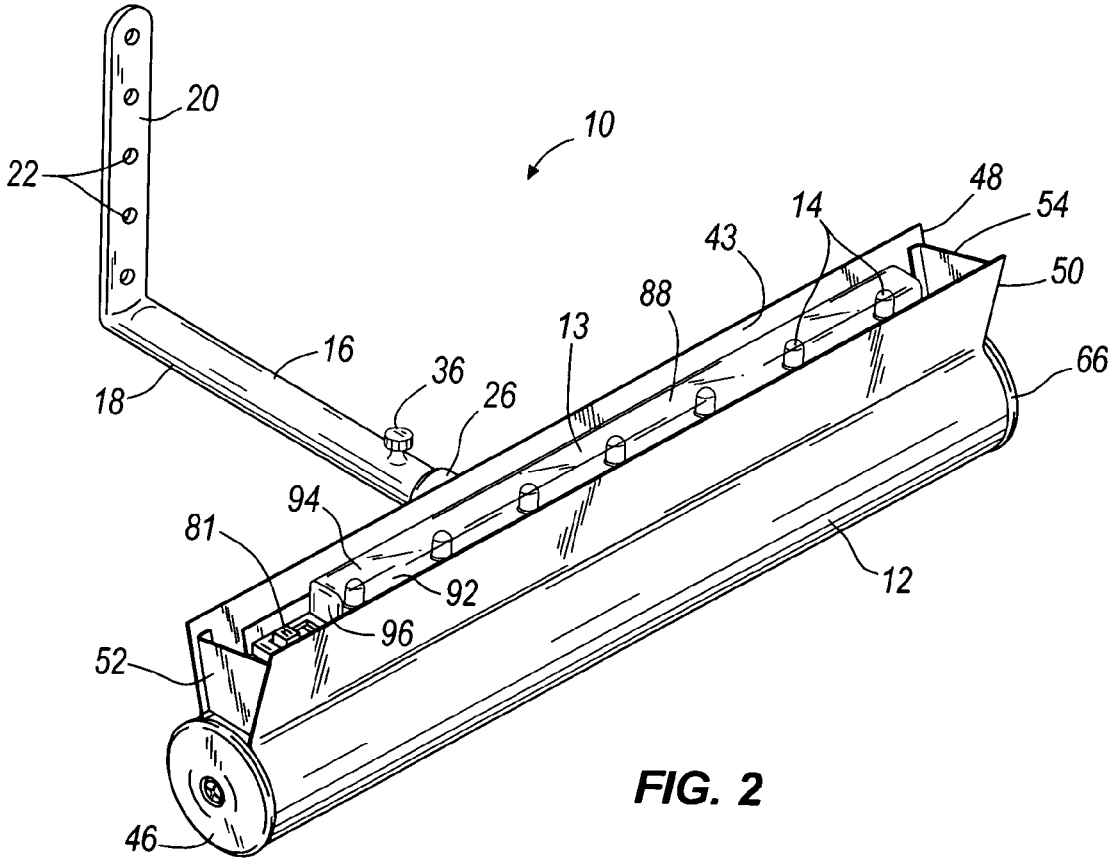
FIG. 2 is a bottom perspective view the picture light of FIG. 1.

FIG. 1 illustrates a picture light 10 according to one embodiment of the invention. As used herein and in the appended claims, the term "picture" refers to a picture mounted to a wall or any other type of artwork or piece of art, whether or not mounted to a wall or to any other suitable mounting surface. Similarly, the term "picture light" refers to a device capable of illuminating a picture mounted to a wall or any other type of artwork or piece of art, whether or not mounted to a wall or to any other suitable mounting surface. The picture light 10 can be positioned adjacent to a picture (not shown) in order to illuminate the picture. As shown in FIG. 2, the picture light 10 includes a housing 12 and a lighting assembly 13 including one or more LED's 14 coupled to the housing 12. In some embodiments, the housing 12 is at least partially constructed of brass-plated steel.

Figure 3:
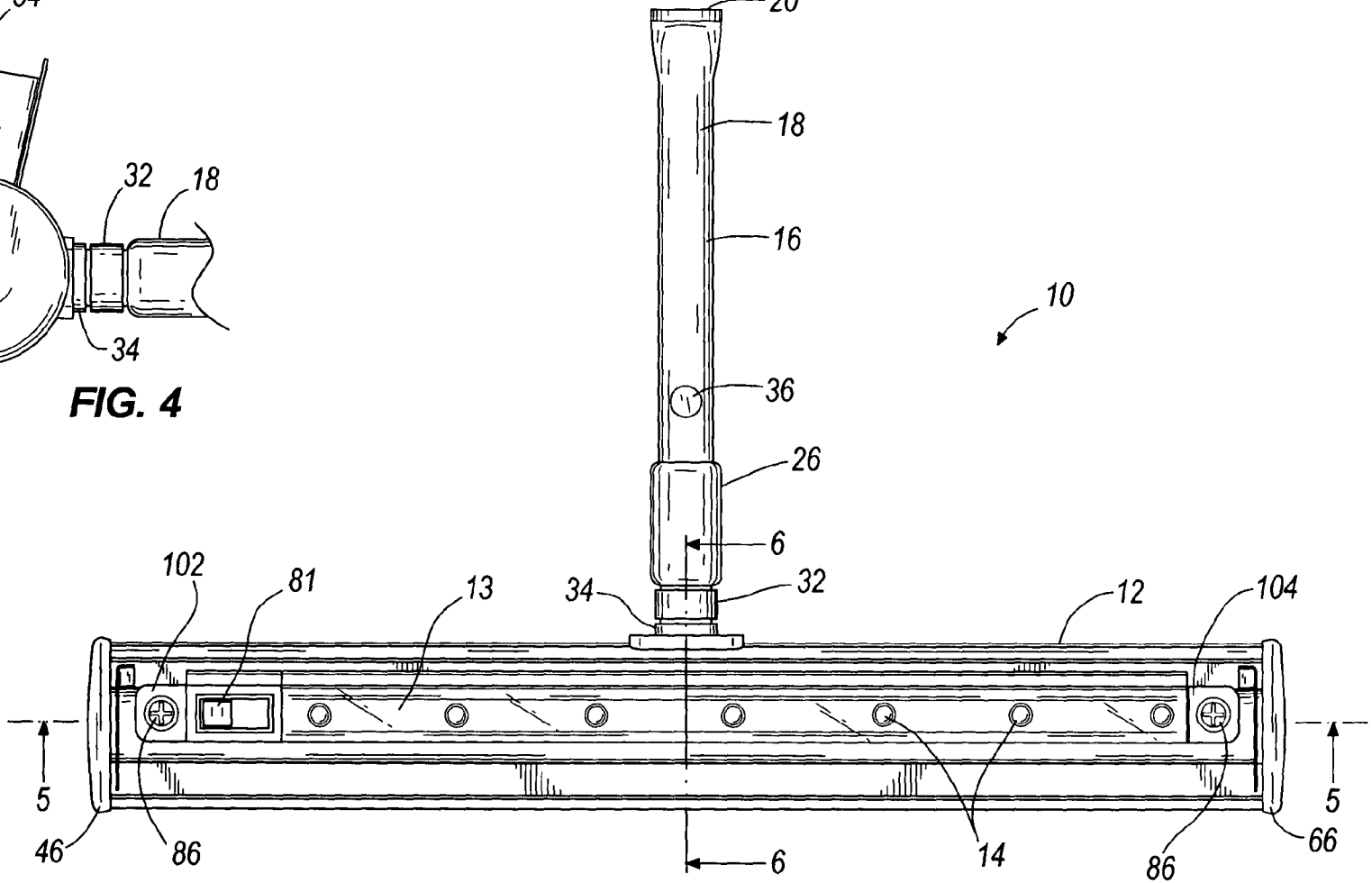
FIG. 3 is a bottom plan view of the picture light of FIG. 1.
Figure 4:
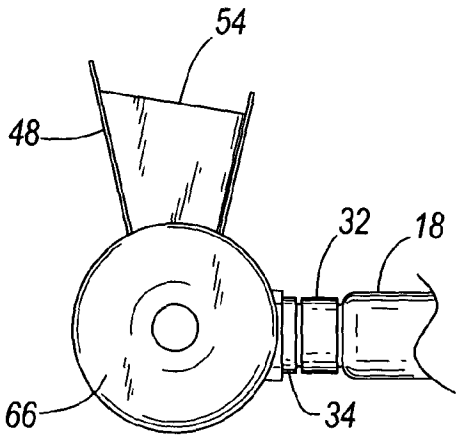
FIG. 4 is a partial side elevational view of the picture light of FIG. 1.
Figure 7:
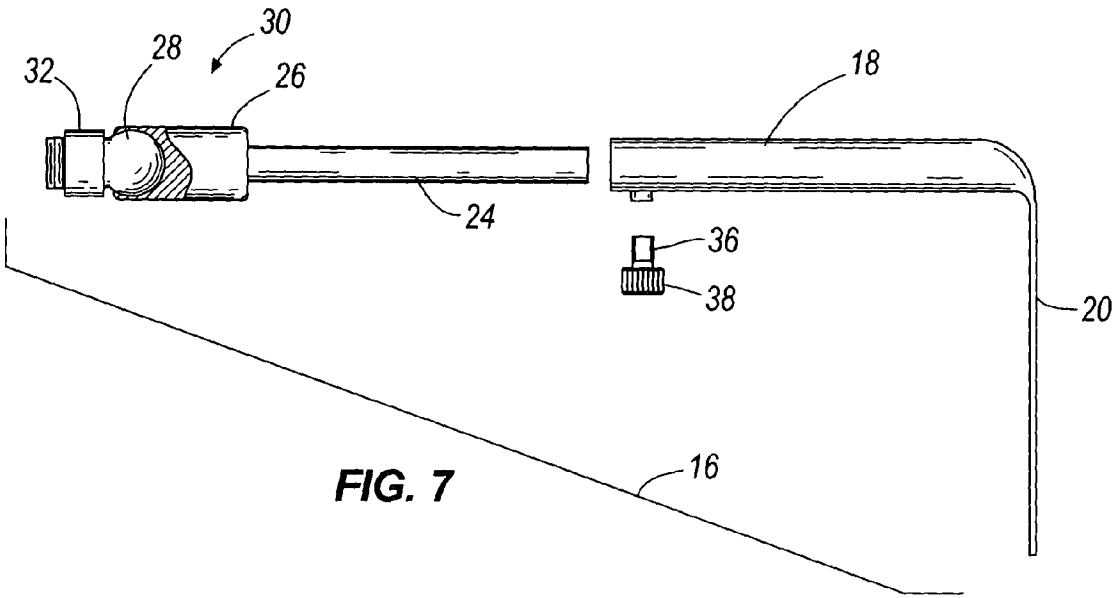
FIG. 7 is an exploded partial cross-sectional view of a bracket of the picture light of FIG. 1.

As shown in FIGS. 1–3, the picture light can include a bracket 16 coupled to the housing 12. In some embodiments, similar to the housing 12, the bracket 16 is at least partially constructed of brass-plated steel. The housing 12 and/or the bracket 16 can also be constructed of any other suitable material or combination of materials, such as materials that are gold, silver, or copper in color, or materials that are painted, molded, or plated in a particular color or finish (e.g., brushed metal or chrome finishes). The bracket 16 can be attached, for example, to a wall adjacent to the picture or to a picture frame positioned around the picture. The bracket 16 can also be attached to any other suitable mounting surface via any suitable type of fastener (e.g., screws, dry-wall attachments, nuts and bolts, adhesives, high-strength double-sided tape, etc.). In one embodiment, as shown in FIGS. 1, 2 and 7, the bracket 16 can include a substantially horizontal member 18 and a substantially vertical member 20. The vertical member 20 can be attached to a wall or any other suitable mounting surface through one or more holes 22 with any suitable fastener (e.g., dry-wall screws, bolts, etc.).

As shown in FIG. 7, the bracket 16 can include a telescoping member 24 positioned within the horizontal member 18. In some embodiments, the telescoping member 24 can be coupled to a female receiving socket 26. The female receiving socket 26 can be rotatably coupled to a male ball member 28 in order to create a ball-and-socket joint 30. The male ball member 28 can be rigidly coupled to the housing 12 via a male threaded connector 32. The male threaded connector 32 can be received within a corresponding female threaded recess 34 (as shown in FIG. 3) in the housing 12. In the embodiment shown in FIG. 7, the housing 12 can rotate with respect to the bracket 16 about the ball-and-socket joint 30 so that a user can position the housing 12 in order to properly illuminate the picture with the light emitted by the LED's 14. The housing 12 can also be positioned longitudinally with respect to the wall or mounting surface by moving the telescoping member 24 into or out of the horizontal member 18. The telescoping member 24 can be secured in a particular position by tightening a thumb screw 36. The thumb screw 36 can include a knurl exterior surface 38 that is easily grasped between a user's fingers.

Figure 8:
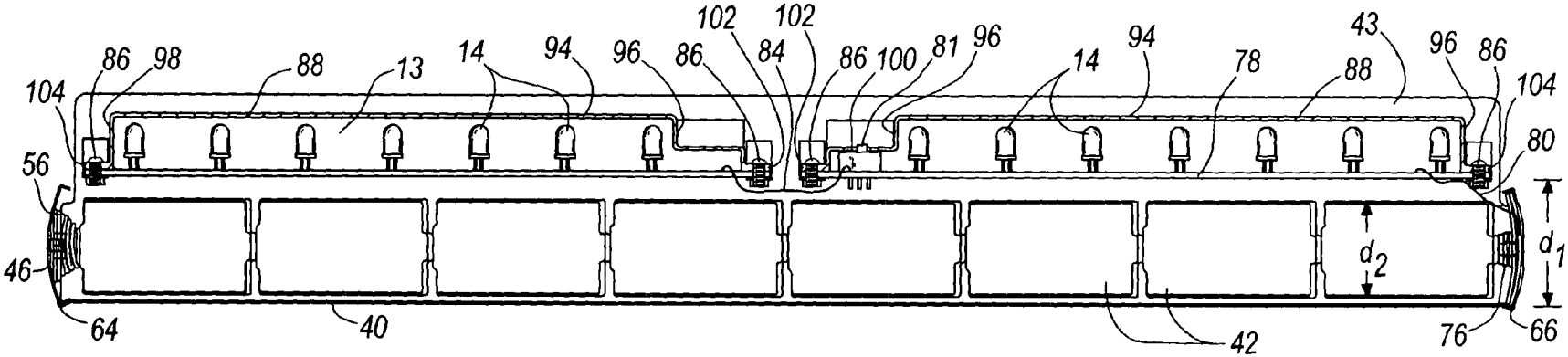
FIG. 8 is a cross-sectional view of a housing and a lighting assembly of a picture light according to an alternative embodiment of the invention.
Figure 12A:
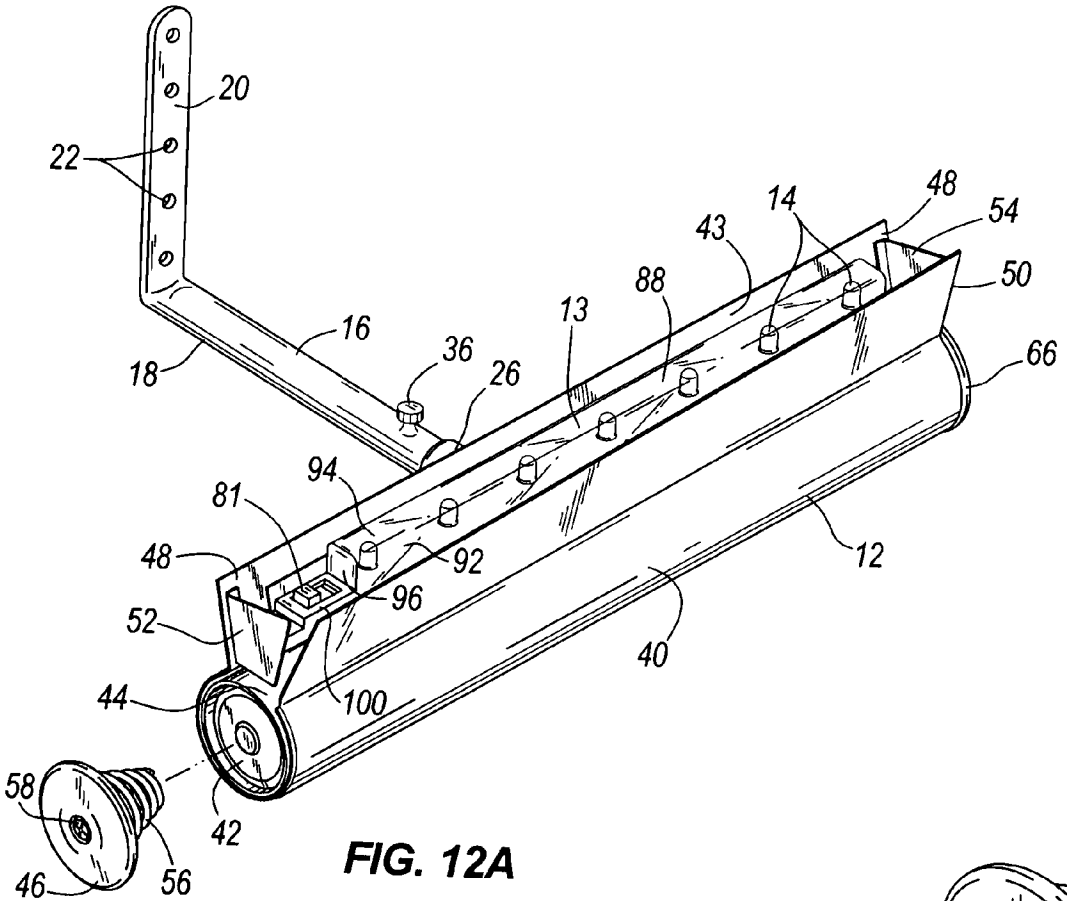
FIGS. 12A and 12B are a side perspective view and a detail perspective view of the housing of the picture lights of FIGS. 1 and 8 with an end cap removed.

As shown in FIGS. 8 and 12A, the housing 12 can include a partially-open cylindrical shell 40 that is capable of storing one or more batteries 42. As shown in FIG. 6, the cylindrical shell 40 can be partially open in order to define a longitudinal opening 43 within which the LED's 14 can be positioned. In the embodiment shown in FIGS. 1–5 and 12A–12B, the housing 12 is capable of storing four standard C-sized batteries and the cylindrical shell 40 is approximately 8 inches long. In the embodiment shown in FIG. 8, the housing 12 is capable of storing eight standard C-sized batteries and the cylindrical shell 40 is approximately 16 inches long. In other embodiments, the housing 12 is capable of storing one or more standard D-sized batteries. As shown in FIG. 8, the cylindrical shell 40 can have a diameter $d_1$ that is greater than a diameter $d_2$ of the batteries 42. In some embodiments, the diameter $d_1$ is only slightly greater than the diameter $d_2$ in order to keep the cylindrical shell 40 of the housing 12 as small as possible. However, the housing 12 can be designed to store any suitable size, type, or quantity of batteries (e.g., any standard or non-standard size of rechargeable or non-rechargeable batteries).

Figure 12B:
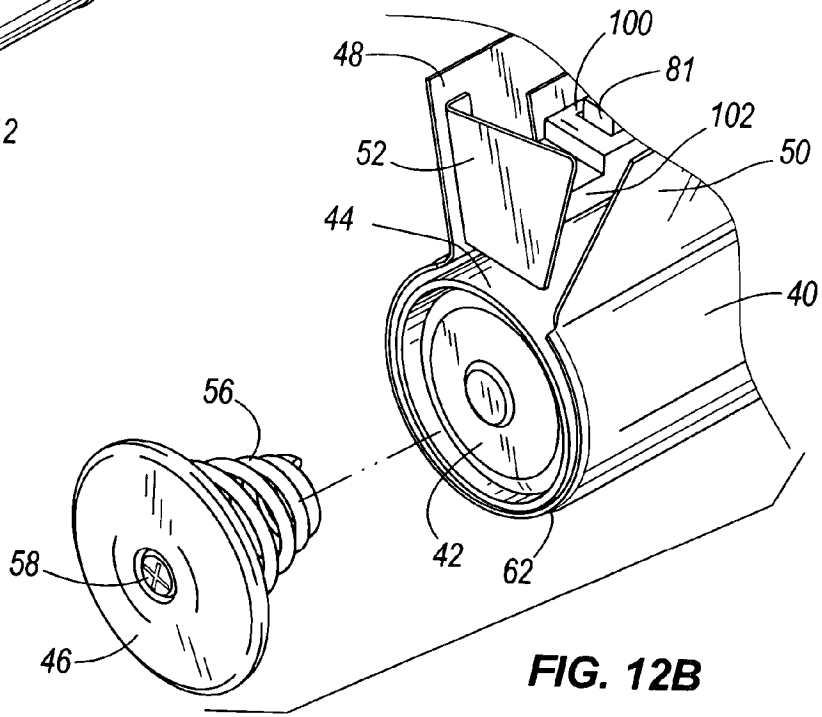

As shown in FIGS. 12A and 12B, in some embodiments, the housing 12 includes a tube 44 positioned around the exterior surfaces of the batteries 42 between the batteries 42 and the interior of the cylindrical shell 40. The tube 44 can be constructed of an inexpensive material, such as cardboard, and can include a white exterior surface in order to reflect the light emitted by the LED's 14. The interior and/or exterior of the tube 44 can also be coated with a fluid-resistant material, such as a thin sheet of transparent plastic. As a result, the tube 44 can help prevent battery acid from leaking out of the picture light 10 onto the picture. The tube 44 can also cushion the batteries 42 with respect to the interior of the cylindrical shell 40 of the housing 12. In addition, the tube 44 can prevent the batteries 42 from being seen through the longitudinal opening 43 from outside of the housing 12.

In some embodiments, as shown in FIGS. 12A and 12B, the housing 12 includes a first end cap 46 removably positioned on one end of the cylindrical shell 40. The first end cap 46 can be removed in order to allow a user to replace the batteries 42. In some embodiments, the user can remove the first end cap 46 without the use of any tools. More specifically, as shown in FIGS. 2, 12A and 12B, the housing 12 can include a first light-directing plate 48 and a second light-directing plate 50. A user can move the first light-directing plate 48 closer to the second light-directing plate 50 (i.e., squeeze the plates together) in order to release the first end cap 46 from the cylindrical shell 40. The housing 12 can also include a first side plate 52 and a second side plate 54. In one embodiment, as shown in FIGS. 12A and 12B, only one side of the first side plate 52 is coupled to the first light-directing plate 48 so that the first side plate 52 does not prevent the user from moving the first and second light-directing plates 48 and 50 toward one another.

Figure 5:
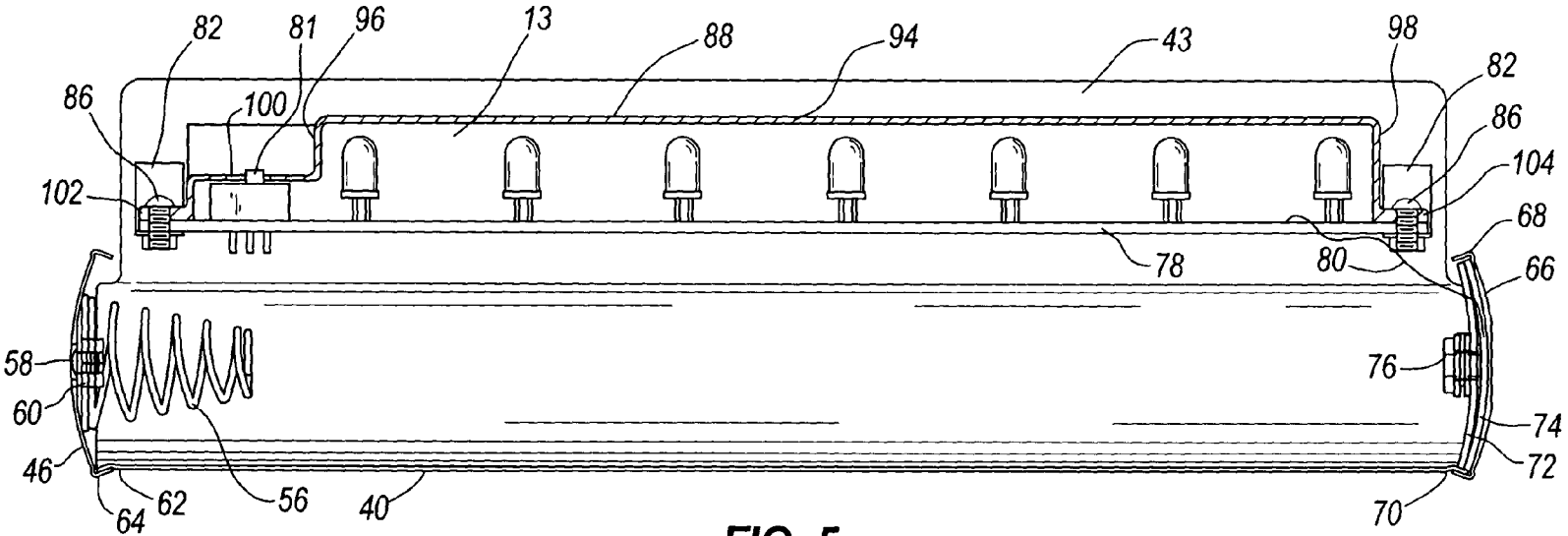
FIG. 5 is a cross-sectional view of a housing and a lighting assembly of the picture light of FIG. 1 taken along line 5—5 of FIG. 3.
Figure 11:
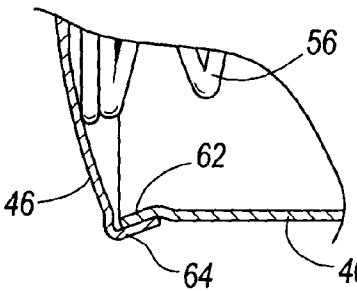
FIG. 11 is a detail view of the housing of the picture lights of FIGS. 1 and 8.
Figure 6:
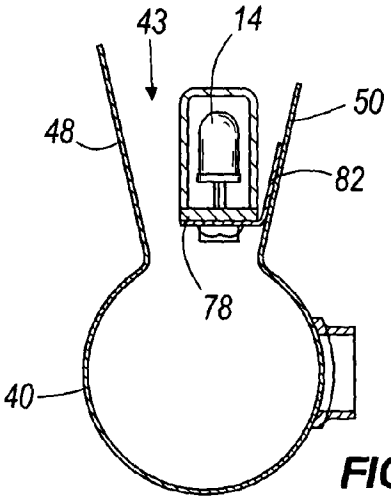
FIG. 6 is a cross-sectional view of the housing and the lighting assembly of the picture light of FIG. 1 taken along line 6—6 of FIG. 3.

As shown in FIGS. 5, 12A and 12B, the first end cap 46 can be coupled to a spring 56 with any suitable fastener or fasteners, such as a bolt 58 and a nut 60, or the spring 56 can be welded to the first end cap 46. As shown in FIG. 8, the spring 56 can compress against the end of the batteries 42 when the first end cap 46 is secured to the cylindrical shell 40. The first end cap 46 can be secured to the cylindrical shell 40 with a snap-fit connection, as shown in FIG. 11. The cylindrical shell 40 can include an annular ridge 62. The first end cap 46 can include an annular flange 64 that fits over the annular ridge 62. In order to secure the first end cap 46 to the cylindrical shell 40, a user can squeeze the first and second light-directing plates 48 and 50 together, position the annular flange 64 of the first end cap 46 over the annular ridge 62 of the cylindrical shell 40, and release the first and second light-directing plates 48 and 50 so that they separate from one another. The annular ridge 62 of the cylindrical shell 40 will then press against the annular flange 64 of the first end cap 46.

As shown in FIGS. 1, 5 and 8, the housing can also include a second end cap 66 secured to the opposite end of the cylindrical shell 40 as the first end cap 46. In some embodiments, the second end cap 66 is permanently secured to the cylindrical shell 40. Similar to the first end cap 46, the second end cap 66 can include an annular flange 68 that is positioned over an annular ridge 70 on the cylindrical shell 40, as shown in FIG. 5. However, unlike the first end cap 46, the annular flange 68 can be permanently secured to the annular ridge 70 in any suitable manner. For example, the second side plate 54 (as shown in FIGS. 2 and 12A) can be permanently coupled to both the first and second light-directing plates 48 and 50, so that a user cannot squeeze the first and second light-directing plates 48 and 50 together near the second end plate 66. As shown in FIG. 5, the second end cap 66 can also include a first insulator disc 72 and a second insulator disc 74. The first and second insulator discs 72 and 74 can be constructed of an electrically-insulating material, such as polystyrene. In addition, as shown in FIGS. 5 and 8, the second end cap 66 can also include a battery contact 76 constructed of an electrically-conductive material. As also shown in FIGS. 5 and 8, the battery contact 76 can be connected to a circuit board 78 by a wire 80.

The wire 80 (or the wire 80 in conjunction with conductive traces on the circuit board 78) can be connected to a switch 81. The switch 81 can be connected between the batteries 42 and the LED's 14 in order to allow a user to turn the picture light 10 ON and OFF. As shown in FIG. 12A, the switch 81 can be a slider switch with ON and OFF positions. However, any suitable switch can be used, such as a rotary switch (e.g., as often used in table and floor lamps), a switch having more than two positions for more than two light-intensity settings (e.g., a three-way rotary switch used in table lamps), a switch that operates when touched by a user, etc. In one embodiment, a rotary switch can be located adjacent to the second end cap 46 and can be in contact with the positive end of the batteries 42. Rather than the switch 81, any suitable user-manipulatible control can be used in other embodiments, such as keypads or touch pads (e.g., devices used to control the lighting in an entire home or building), sliders, dials, variable switches, thumb wheels, dual inline package switches, or other input devices suitable for human operation.

As shown in FIGS. 5, 6 and 8, the LED's 14 can be coupled to the circuit board 78. The circuit board 78 can be positioned in the longitudinal opening 43 of the cylindrical shell 40 and secured to one or both of the first and second light-deflecting plates 48 and 50 by one or more brackets 82 (as shown in FIG. 6). As shown in FIG. 8, two separate circuit boards 78 can be positioned in the longitudinal opening 43 of the cylindrical shell 40 and can be connected to one another by a wire 84. As shown in FIG. 6, the brackets 82 can be welded or otherwise secured to one or both of the first and second light-deflecting plates 48 and 50. As shown in FIGS. 5 and 8, the circuit board or boards 78 can be coupled to the brackets 82 by one or more fasteners 86 or any other suitable fastening device or method.

One or more LED's 14 can be connected to the circuit board 78. As used herein and in the appended claims, the term "light-emitting diode" or "LED" includes LED's of all types, such as light-emitting polymers, semiconductor dies that produce light in response to current, organic LED's, electro-luminescent strips, silicon-based structures that emit light, etc. The term "light-emitting diode" or "LED" may also refer to a single LED package having multiple semiconductor dies that are either individually or collectively controlled. In addition, the term "light-emitting diode" or "LED" may refer to packaged or non-packaged LED's, surface-mount LED's, chip on board LED's, etc. Moreover, the term "light-emitting diode" or "LED" may refer to LED's packaged or associated with phosphor wherein the phosphor may convert energy from the LED to a different wavelength. The LED's 14 can be equally spaced apart from one another along the length of the circuit board 78.

In some embodiments, the LED's 14 include white and yellow LED's (e.g., suitable white LED's having a model number of B5-430-TH are manufactured by ETR; also suitable white LED's having a model number NSPW510BS are manufactured by Nichia; suitable yellow LED's having a model number of L53SYD are manufactured by Kingbright). Yellow LED's generally cost less than white LED's, because each white LED usually includes three individual green, red and blue LED's inside the single white LED that combine to create white light. Not only do yellow LED's cost less, but the addition of yellow LED's to the white LED's broadens the light spectrum emitted by the picture light 10 to create light that is more rich. Although some embodiments can include only white LED's, the use of white LED's only can result in blue colors in pictures being over emphasized or accentuated.

Although yellow LED's are combined with white LED's in some embodiments, other embodiments can include only white LED's or white LED's combined with LED's having any suitable other color or other combinations of colors (e.g., one or more of green, blue, and red LED's). Rather than trying to create only white light, other combinations of colors of LED's can be used to create particular visual effects in order to illuminate the picture in different manners. The term "color" and the colors referred to herein and in the appended claims refer to one or more particular frequencies of radiation or combinations of frequencies of radiation within the visible light spectrum (although frequencies of radiation outside of the visible light spectrum, such as in the infrared and/or ultraviolet spectrums, could be used for particular purposes). For the purpose of illuminating pictures, the LED's 14 of the picture light 10 can illuminate the picture without emitting any substantial amounts of ultraviolet radiation (which can fade pictures, especially paintings) or any substantial amounts of heat (which can damage pictures). However, ultraviolet radiation can also be filtered by using a lens constructed of polycarbonate.

Figure 9:
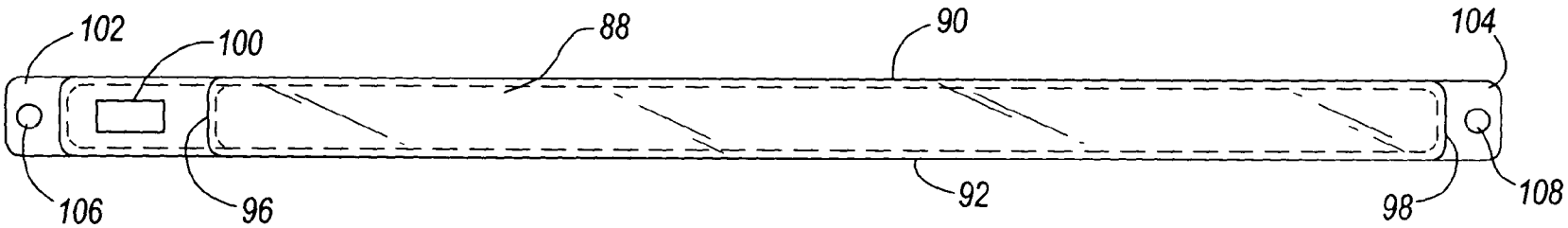
FIG. 9 is a top plan view of a lens of the picture lights of FIGS. 1 and 8.
Figure 10:
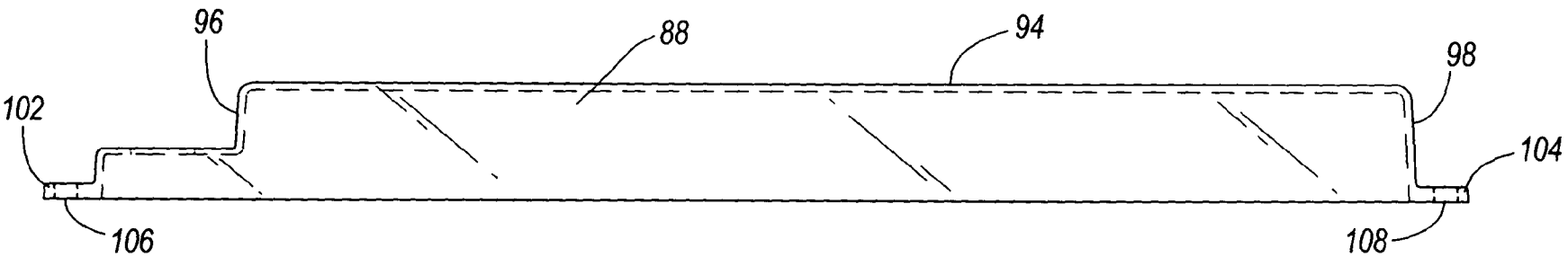
FIG. 10 is a side elevational view of the lens of FIG. 9.

In order to combine and diffuse the different colors of light emitted by the LED's 14, the picture light 10 can include a lens 88 positioned to at least partially cover the LED's 14 or, as shown in FIGS. 2 and 12A, to substantially cover the LED's 14. The lens 88 can be constructed of polystyrene. The lens 88 can be translucent, frosted, or beveled. In some embodiments, the lens 88 is 1/16 of an inch thick. As shown in FIGS. 9 and 10, the lens 88 can include first and second longitudinal faces 90 and 92, a top face 94, and first and second side faces 96 and 98. The lens 88 can also include an aperture 100 through which at least a portion of the switch 81 can be positioned. The lens 88 can include first and second attachment flanges 102 and 104 having holes 106 and 108, respectively. The fasteners 86 can be positioned within the holes 106 and 108 in order to secure the lens 88 onto the circuit board 78 over the LED's 14. Rather than or in addition to using a lens 88 to combine the different colors emitted by the LED's 14, the differently-colored LED's can be grouped together (i.e., each group can include one yellow LED positioned directly adjacent to one white LED).

Figure 13:
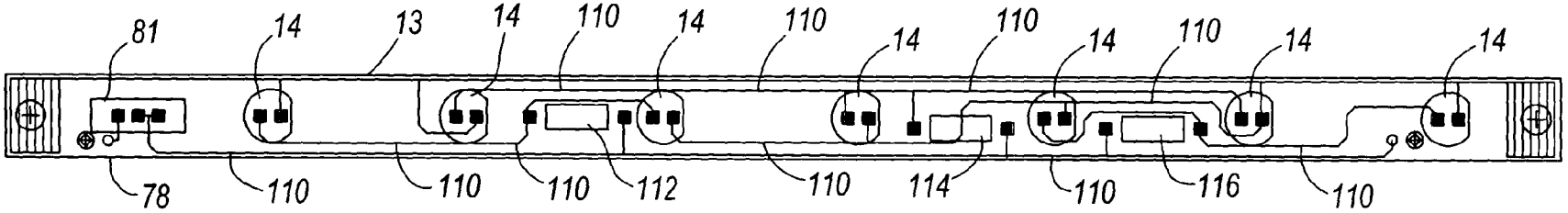
FIG. 13 is an electrical schematic for the lighting assembly of the picture lights of FIGS. 1 and 8.

As shown in FIG. 13, the circuit board 78 can include several conductive traces 110 between the LED's 14. The circuit board 78 can also include one or more resistors (e.g., resistors 112, 114, and 116). In one embodiment, the resistor 112 is a 47Ω resistor, the resistor 114 is a 62Ω resistor, and the resistor 116 is a 47Ω resistor. In this embodiment, these particular resistance values are selected and the appropriate connections are made on the circuit board 78 in order to provide approximately 3 Volts to the white LED's and approximately 1.5 Volts to the yellow LED's. In other embodiments, 110Ω resistors can be used to provide an appropriate voltage to the LED's 14. The resistors are generally selected in order to divide the voltage from the batteries 42 into the appropriate voltages for the LED's 14 while using the least number of resistors. The resistors and LED's 14 can be connected in series or in parallel in order to achieve the desired light output.

In some embodiments, the LED's 14 can illuminate a picture for at least approximately 35 hours and up to approximately 72 hours before the light emitted by the LED becomes diminished (e.g., diminished in intensity) due to the batteries 42 becoming depleted (e.g., before the batteries 42 are substantially depleted and must be replaced). The illumination time for the batteries 42 generally depends on the number and size of batteries 42 used in the picture light 10. In some embodiments, the LED's 14 have a total illumination lifespan of at least approximately 10,000 hours. As a result, the LED's 14 do not need to be replaced like fluorescent or incandescent light bulbs. Rather, a user only replaces the batteries 42 in the picture light 10.

Figure 15:
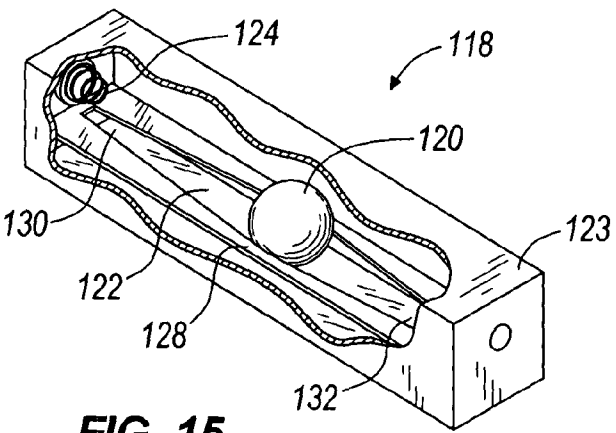
FIG. 15 is a top perspective view of the level sensor of FIG. 14.
Figure 14:
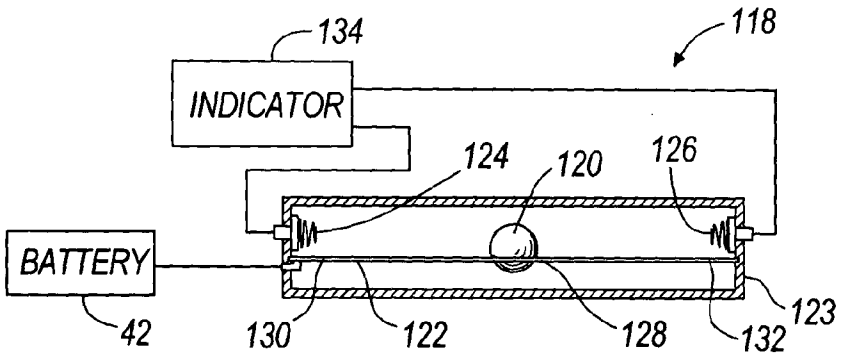
FIG. 14 is a schematic illustration of a level sensor according to one embodiment of the invention for use with the picture lights of FIGS. 1 and 8.

In some embodiments, the picture light 10 can include a level sensor 118, as shown in FIGS. 14 and 15. When the picture light 10 is coupled to the picture or the picture frame, the level sensor 118 can be coupled to the housing 12 and/or the bracket 16 of the picture light 10. The level sensor 118 can generate a signal to a user when the picture is not level and/or assist the user in automatically leveling a picture. In one embodiment, the level sensor 118 can include a metallic ball contact 120 positioned on an anode rail 122, both of which can be positioned inside a covering 123. The metallic ball contact 120 can be at least partially constructed of steel, copper, or brass or any other suitable electrically-conductive material or combination of materials. In some embodiments, the anode rail 122 can be at least partially constructed of gold. The level sensor 118 can also include a first cathode contact 124 positioned at a first end of the anode rail 122 and a second cathode contact 126 positioned at a second end of the anode rail 122. The first cathode contact 124 and the second cathode contact 126 can each include a spring, a screw, a wire, or any other suitable electrical contact.

Figure 16:
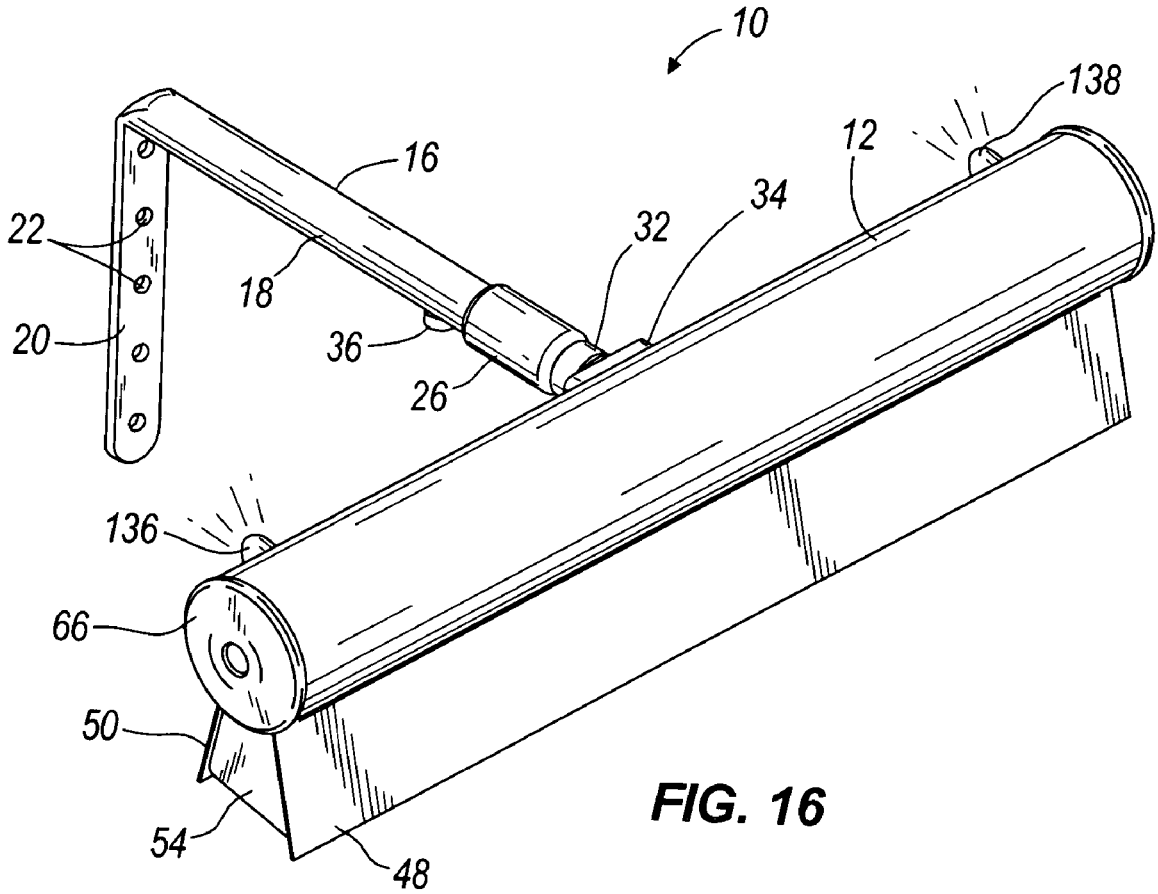
FIG. 16 is a top perspective view of a picture light having a level indicator according to another embodiment of the invention.

The metallic ball contact 120 can move or roll between a first level position 128 (i.e., a position between the first cathode contact 124 and the second cathode contact 126) and one of two second non-level positions 130 and 132 (i.e., positions adjacent to one of the first cathode contact 124 and the second cathode contact 126, respectively). As shown schematically in FIG. 14, the metallic ball contact 120 can connect the anode rail 122 to either one of the first cathode contact 124 and the second cathode contact 126 (depending on the direction in which the picture is not level) in order to complete an electrical circuit between the batteries 42 and an indicator 134. In some embodiments, the indicator 134 is an LED coupled to the housing 12 or the bracket 16. Also, the LED indicator 134 can blink until the metallic ball contact 120 returns to the first level position 128. In addition, the LED indicator 134 can be positioned on the housing 12 or the bracket 16 in order to shine against a wall upon which the picture is mounted. In one embodiment, the level sensor 118 is sensitive to the picture being approximately 2° off from being level. FIG. 16 illustrates the picture light 10 and, according to one embodiment, a first LED indicator 136 and a second LED indicator 138 positioned adjacent to the ends of the housing 12. One or both of the first and second LED indicators 136 and 138 can light up in any suitable manner in response to the level sensor 118.

The invention claimed is:

1. A picture light powered by at least a battery, said picture light comprising:

a housing positionable adjacent to a picture in order to illuminate the picture, the housing storing the at least one battery;

a tube positioned between the housing and the at least one battery, the tube constructed of a material cushioning the at least one battery with respect to the housing; and at least one light-emitting diode coupled to the housing, the at least one light emitting diode illuminating the picture without emitting substantial amounts of heat and without emitting substantial amounts of ultraviolet radiation.

2. A picture light powered by at least a battery, said picture light comprising:

a housing positionable adjacent to a picture in order to illuminate the picture, the housing storing the at least one battery;

a tube positioned between the housing and the at least one battery, the tube constructed of a material substantially preventing battery acid from leaking onto the picture; and at least one light-emitting diode coupled to the housing, the at least one light-emitting diode illuminating the picture without emitting substantial amounts of heat and without emitting substantial amounts of ultraviolet radiation.

3. A picture light powered by at least a battery, said picture light comprising:

a housing positionable adjacent to a picture in order to illuminate the picture, the housing storing the at least one battery:

a tube positioned between the housing and the at least one battery, the tube constructed of a material cushioning the at least one battery with respect to the housing;

at least one light-emitting diode coupled to the housing, the at least one light-emitting diode illuminating the picture for at least approximately 35 hours before substantially depleting the at least one battery.

4. A picture light powered by at least a battery, said picture light comprising:

a housing positionable adjacent to a picture in order to illuminate the picture, the housing storing the at least one battery;

a tube positioned between the housing and the at least one battery, the tube constructed of a material substantially preventing battery acid from leaking onto the picture;

at least one light-emitting diode coupled to the housing, the at least one light-emitting diode illuminating the picture for at least approximately 35 hours before substantially depleting the at least one battery.

5. A picture light powered by at least a battery, said picture light comprising:

a housing positionable adjacent to a picture in order to illuminate the picture, the housing storing the at least one battery;

a tube positioned between the housing and the at least one battery, the tube constructed of a material cushioning the at least one battery with respect to the housing; and a plurality of light-emitting diodes coupled to the housing, the plurality of light-emitting diodes including at least one white light-emitting diode and at least one yellow light-emitting diode.

6. A picture light powered by at least a battery, said picture light comprising:

a housing positionable adjacent to a picture in order to illuminate the picture, the housing storing the at least one battery;

a tube positioned between the housing and the at least one battery, the tube constructed of a material substantially preventing battery acid from leaking onto the picture; and a plurality of light-emitting diodes coupled to the housing, the plurality of light-emitting diodes including at least one white light-emitting diode and at least one yellow light-emitting diode.

7. A picture light comprising:

a housing positionable adjacent to a picture in order to illuminate the picture;

a bracket coupled to the housing, the bracket being attachable to at least one of a wall adjacent to the picture and a picture frame positioned around a perimeter of the picture; and a level sensor coupled to at least one of the housing and the bracket, the level sensor including a metallic ball contact positioned on an anode rail, a first cathode contact positioned at a first end of the anode rail, and a second cathode contact positioned at a second end of the anode rail, the metallic ball contact capable of moving between a first level position located between the first cathode contact and the second cathode contact and a second non-level position adjacent to one of the first cathode contact and the second cathode contact, the metallic ball contact connecting the anode rail to one of the first cathode contact and the second cathode contact in order to generate a signal when the picture is not level, the signal controlling an indicator light-emitting diode coupled to one of the housing and the bracket, the indicator light-emitting diode blinking until the metallic ball contact returns to the first level position.

8. A picture light comprising:

a housing positionable adjacent to a picture in order to illuminate the picture;

a bracket coupled to the housing, the bracket being attachable to at least one of a wall adjacent to the picture and a picture frame positioned around a perimeter of the picture; and a level sensor coupled to at least one of the housing and the bracket, the level sensor including a metallic ball contact positioned on an anode rail, a first cathode contact positioned at a first end of the anode rail, and a second cathode contact positioned at a second end of the anode rail, the metallic ball contact capable of moving between a first level positions located between the first cathode contact and the second cathode contact and a second non-level position adjacent to one of the first cathode contact and the second cathode contact, the metallic ball contact connecting the anode rail to one of the first cathode contact and the second cathode contact in order to generate a signal when the picture is not level, the signal controlling an indicator light-emitting diode coupled to one of the housing and the bracket, the indicator light-emitting diode is positioned to shine against a wall upon which the picture is mounted.

* * * * *